US005325744A

United States Patent [19]

Horikawa

[11] Patent Number: 5,325,744

[45] Date of Patent: Jul. 5, 1994

[54] WRENCH HAVING WRENCH SLEEVES REVERSIBLE UPSIDE DOWN

[75] Inventor: Masao Horikawa, Sanjo, Japan

[73] Assignee: Hokuyo Sangyo Co., Ltd., Niigata, Japan

[21] Appl. No.: 980,274

[22] Filed: Nov. 23, 1992

[30] Foreign Application Priority Data

Nov. 30, 1991 [JP] Japan ..... 3-317186

[51] Int. Cl.[5] ..... B25B 13/46

[52] U.S. Cl. ..... 81/63.2; 81/124.5

[58] Field of Search ..... 81/60–63.2, 81/124.5, 177.8, 177.9

[56] References Cited

U.S. PATENT DOCUMENTS

| | | | |
|---|---|---|---|
| 648,572 | 5/1900 | Patterson | 81/177.8 X |
| 2,709,386 | 5/1955 | Hopgood | 81/63 X |
| 3,754,486 | 8/1973 | Mariner | 81/63 |
| 4,819,521 | 4/1989 | Lang | 81/63 |
| 5,119,701 | 6/1992 | Wei | 81/63 |

FOREIGN PATENT DOCUMENTS

| | | |
|---|---|---|
| 420586 | 9/1953 | Japan . |
| 430490 | 7/1969 | Japan . |
| 368773 | 7/1991 | Japan . |

*Primary Examiner*—James G. Smith

*Attorney, Agent, or Firm*—Sughrue, Mion, Zinn, Macpeak & Seas

[57] ABSTRACT

A wrench has at least one wrench sleeve. Wrench holes different in size are formed at a top and a bottom of the wrench sleeve mounted horizontally rotatable within wrench receiving portion provided at an end of a grip handle. Ratchet teeth are formed on an outer peripheral surface of the wrench sleeve. A switch lever has ratchet pawls each engageable with the ratchet teeth that are provided on one side of the wrench sleeve. The wrench is characterized in that the wrench sleeve has a barrel shape, and the wrench sleeve is mounted within the wrench receiving portion so as to be rotatable through 180° with upper and lower opening surfaces being reversible upside down.

9 Claims, 2 Drawing Sheets

WRENCH HAVING WRENCH SLEEVES REVERSIBLE UPSIDE DOWN

BACKGROUND OF THE INVENTION

The present invention relates to a wrench having at both end portions wrench sleeves reversible upside down.

With a wrench, it is impossible to use wrench holes different in size so far as a grip handle is turned upside down by changing the gripped positions. In particular, with a wrench which is of a type with its tip end portions being bent to an obtuse angle, it is impossible to use the wrench well even if the handle is reversed upside down. In this case, therefore, it is impossible to form wrench holes having various different sizes. (Namely, only two kinds of holes in total are provided to one wrench at a front end and a rear end by reversing the handle upside down.)

SUMMARY OF THE INVENTION

In order to overcome the above-noted defects, according to the present invention, there is provided a wrench having at least one wrench sleeve, wherein wrench holes different in size are formed at a top and a bottom of the wrench sleeve mounted horizontally rotatable within a wrench receiving portion provided at an end of a grip handle; ratchet teeth are formed on an outer peripheral surface of the wrench sleeve; and a switch lever having ratchet pawls each engageable with the ratchet teeth is provided on one side of the wrench sleeve; the wrench characterized in that the wrench sleeve has a barrel shape, and the wrench sleeve is mounted within the wrench receiving portion so as to be rotatable through 180° with upper and lower opening surfaces being reversible upside down.

According to another aspect of the invention, there is provided a wrench having wrench sleeves, wherein wrench receiving portions are formed in both end portions of a grip handle which end portions are formed by bending, so that, when an intermediate portion of the grip handle is kept under a slant condition, the wrench receiving portions are kept in a horizontal condition; wrench holes different in size are formed at tops and bottoms of the wrench sleeves mounted horizontally rotatable within the wrench receiving portions; ratchet teeth are formed on an outer peripheral surface of each of the wrench sleeves; and a switch lever having ratchet pawls each engageable with the ratchet teeth is provided on one side of the wrench sleeves; the wrench characterized in that each of the wrench sleeves has a barrel shape, and the wrench sleeves are mounted within the wrench receiving portions so as to be rotatable through 180° with upper and lower opening surfaces being reversible upside down.

The wrench sleeve is mounted within the wrench receiving portion so as to be rotatable to any angle through 360° with upper and lower opening surfaces being reversible upside down.

According to still another aspect of the invention, there is provided a wrench comprising: a grip handle having a first end portion and a second end portion; a first wrench sleeve, wherein a first wrench hole and a second wrench hole which is different in size from that of the first wrench hole are formed in a top and a bottom of the first end portion of the grip handle; a first ratchet means for stopping the first wrench sleeve for wrench operation; and a first rotating means for rotating the first wrench sleeve with the first wrench hole being directed downwardly or upwardly.

The first rotating means comprises first ratchet teeth formed on an outer peripheral surface of the first wrench sleeve; and a switch lever having first ratchet pawls each engageable with the first ratchet teeth provided on one side of the first wrench sleeve.

The first wrench sleeve has a barrel shape, and the first wrench sleeve is mounted at the first end portion of the grip handle so as to be rotatable with the first and second wrench holes being reversible upside down.

The first wrench sleeve is rotatable through 180°.

The first wrench sleeve is rotatable to any angle under the condition that the engagement of the ratchet teeth are released from the ratchet pawls.

The first wrench sleeve is rotatable through 360°.

The wrench further comprises: a second wrench sleeve, wherein a third wrench hole and fourth wrench hole which is different in size from that of the third wrench hole are formed in a top and a bottom of the second end portion of the grip handle; a second ratchet means for stopping the second wrench sleeve for wrench operation; and a second rotating means for rotating the second wrench sleeve with the second wrench hole being directed downwardly or upwardly.

The grip handle is formed of a pair of plates and an intermediate plate interposed between the pair of plates, whereby the first wrench sleeve is held rotatably between the pair of plates.

DESCRIPTION OF THE PREFERRED EMBODIMENTS

The present invention will now be described with reference to the accompanying drawings.

Figure 1:
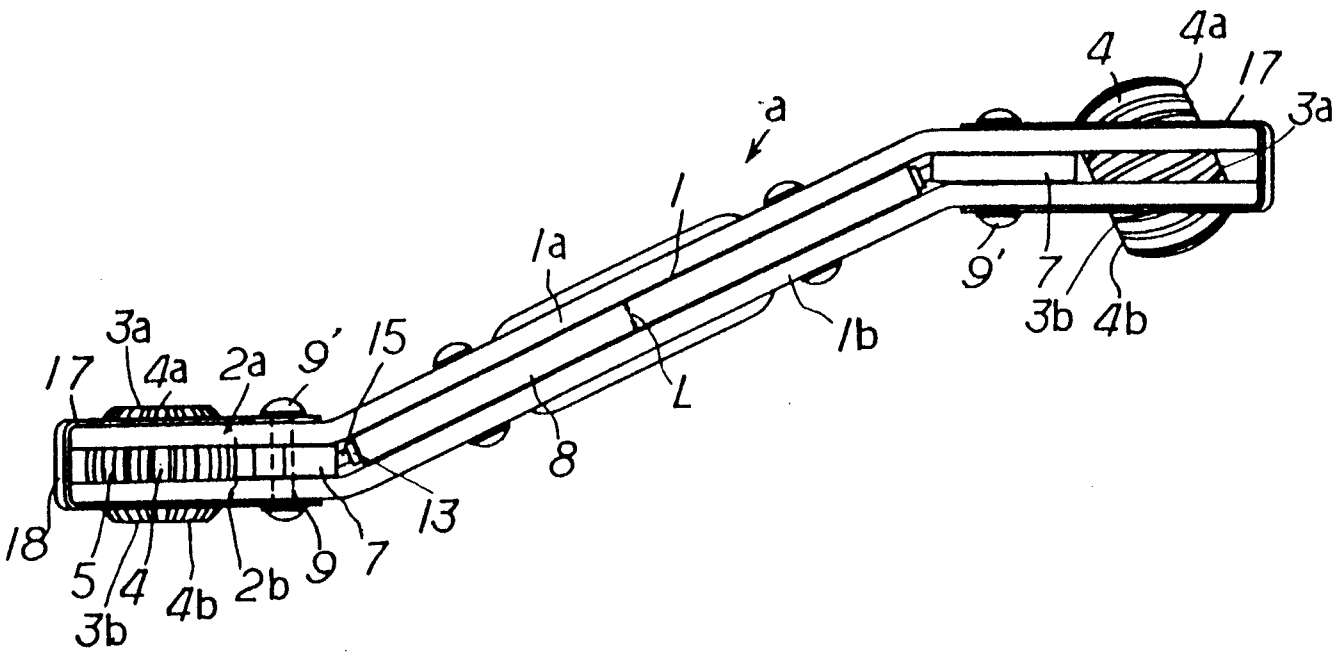
FIG. 1 is a side view showing a wrench according to an embodiment of the invention.

A wrench sleeve 4 having at its top and bottom wrench holes 3*a* and 3*b* which are different in size is provided within a wrench receiving portion 2 at each end portion of a grip handle 1 so as to be rotatable horizontally to any angle through 360°. Ratchet teeth 5 are formed on an outer peripheral surface of the wrench sleeve 4. A switch lever 7 having ratchet pawls 6 that are engageable with the ratchet teeth 5 is provided on one side of a wrench receiving portion 2 on each side of the wrench a. Two grip handle plates 1*a* and 1*b* each having wrench receiving portions 2*a* and 2*b* on both ends are attached to an interposed plate 8 at an interval of several millimeters. The barrel-shaped wrench sleeve 4 is provided between the upper and lower wrench receiving portions 2*a* and 2*b* on each end portion of the wrench a so that the wrench sleeve 4 may be reversible and rotatable as shown in FIG. 1. The most expanded portion of each wrench sleeve 4 may insure a pull-apart preventing effect so that upper and lower opening surfaces 4*a* and 4*b* may be reversibly rotated through 180°.

The switch levers 7 are mounted within the interval L between the grip handle plates 1*a* and 1*b*. Each switch lever 7 is kept under a switched condition by a ratchet switch mechanism 10 that is rotatable about a support shaft 9 for switching the tooth engagement of each ratchet pawl 6.

Figure 2:
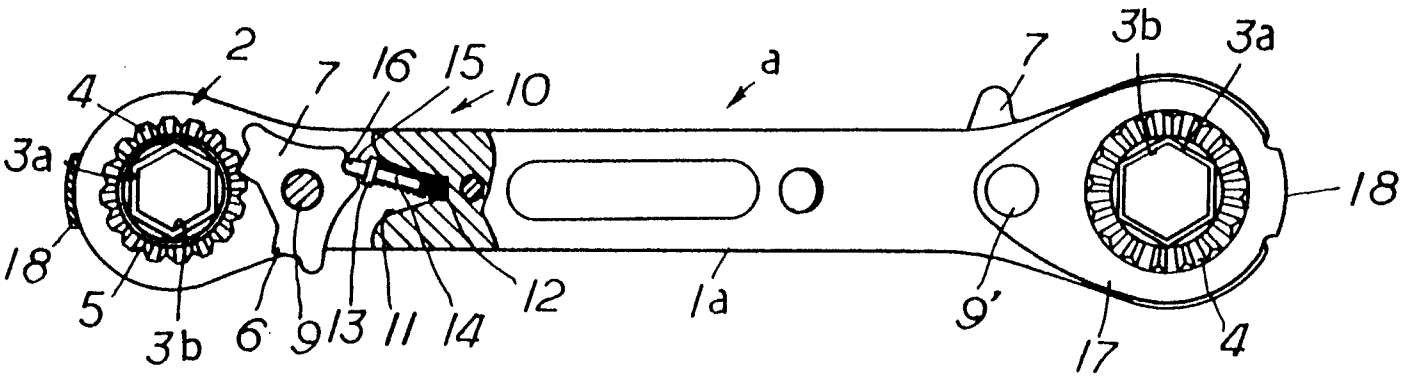
FIG. 2 is a plan view showing the wrench shown in FIG. 1.

In each ratchet switch mechanism 10, a spring sleeve 12 is swingably inserted in a receiving hole 11 having an expanded opening end, and a pin 14 having a spring receiving jaw 13 is inserted into the spring sleeve 12. A switch projection 15 is provided on the spring receiving jaw 13 so that it may be engageable with a switch recess portion 16 formed in an intermediate lower end portion of the switch lever 7 as shown in FIG. 2.

The fixed plates 17 for each wrench sleeve 4 are mounted on the wrench receiving portions 2*a* and 2*b* by a pin 9' which serves as the above-described support shaft 9 for the switch lever 7, and are coupled together by a coupling plate 18.

In the drawings, there are shown four different kinds of large and small wrench holes 3*a* and 3*b* which are provided on both ends in the wrench. Also, in the drawings, there is shown the wrench in which both ends of the grip handle 1 are bent in an obtuse angle in the opposite direction upwardly and downwardly. It is apparent for those skilled in the art to apply the invention to a straight grip handle type wrench. In particular, with the conventional bent handle type wrench, it is impossible to use the opposite side of the wrench hole. According to the present invention, even with this type wrench, it is possible to use selectively the four kinds of the wrench holes in total which are different in size without changing the grip positions since each wrench sleeve 4 may be reversible and rotatable through 180°. Thus, according to the present invention, the usefulness of the wrench is enhanced.

According to the present invention, with the above-described structure, it is possible to rotate the barrel-shaped wrench sleeve through 180° without changing the grip positions to the upside-down state. Accordingly, the wrench may be used for the different wrench holes without changing the wrench. Thus, there is provided a wrench which is superior in practical usefulness, and in which the wrench sleeves are reversible upside down.

What is claimed is:

1. A wrench comprising:

a grip handle having a wrench receiving portion provided at an end thereof;

at least one wrench sleeve, wherein first and second wrench holes different in size are formed at a top and a bottom, respectively, of said wrench sleeve mounted horizontally rotatable within said wrench receiving portion provided at said end of said grip handle;

ratchet teeth formed on an outer peripheral surface of said wrench sleeve; and a switch lever having ratchet pawls each engageable with said ratchet teeth and said switch lever being provided on one side of said wrench sleeve;

said wrench sleeve having a barrel shape, and said wrench sleeve being mounted within said wrench receiving portion so as to be rotatable through 360° both clockwise and counterclockwise in a vertical direction about an axis parallel to a length of said end portion such that first and second opening surfaces formed by said first and second wrench holes are reversible upside down.

2. A wrench comprising:

a grip handle having wrench receiving portions, one of said wrench receiving portions formed in each of first and second end portions of said grip handle;

wrench sleeves, said wrench receiving portions being formed in both said first and second end portions of said grip handle, the first and second end portions being formed by bending, so that, when an intermediate portion of said grip handle is slanted, the wrench receiving portions are horizontal, said wrench sleeves being mounted horizontally rotatable within said wrench receiving portions and having first and second wrench holes different in size being respectively formed at tops and bottoms of said wrench sleeves;

ratchet teeth formed on an outer peripheral surface of each of said wrench sleeves; and a switch lever having ratchet pawls each engageable with said ratchet teeth, said switch lever being provided on one side of said wrench sleeves;

each of said wrench sleeves having a barrel shape, and said wrench sleeves being mounted within said wrench receiving portions so as to be rotatable through 360° both clockwise and counterclockwise in a vertical direction about an axis parallel to a length of said end portion such that first and second opening surfaces formed by said first and second wrench holes are reversible upside down.

3. A wrench comprising:

a grip handle having a wrench receiving portion provided at an end thereof;

at least one wrench sleeve, wherein first and second wrench holes different in size are formed at a top and a bottom, respectively, of said wrench sleeve mounted horizontally rotatable within said wrench receiving portion provided at said end of said grip handle;

ratchet means for stopping said wrench sleeve for wrench operation;

ratchet teeth formed on an outer peripheral surface of said wrench sleeve;

a switch lever having a ratchet pawls each engageable with said ratchet teeth and said switch lever being provided on one side of said wrench sleeve; and rotating means for enabling said wrench sleeve to be rotated such that said first wrench hole can be directed downwardly or upwardly, said wrench sleeve having a barrel shape, and said wrench sleeve being mounted within said wrench receiving portion of said grip handle so as to be rotatable through 360°, both clockwise or counterclockwise in a vertical direction about an axis parallel to a length of said wrench receiving portion, such that said first and second wrench holes are reversible upside down, wherein said wrench sleeve is rotatable through 360° in both a clockwise or a counter-clockwise direction of a horizontal plane under the condition that the engagement of said ratchet teeth is released from said ratchet pawls.

4. A wrench comprising:

a grip handle having first and second wrench receiving portions, one of said first and second wrench receiving portions formed in each of first and second end portions of said grip handle;

a first wrench sleeve, wherein first and second wrench holes different in size are formed in a top and a bottom, respectively, of said first wrench sleeve mounted horizontally rotatable within said first wrench receiving portion provided at said first end portion of said grip handle;

first ratchet means for stopping said first wrench sleeve for wrench operation;

first ratchet teeth formed on an outer peripheral surface of said first wrench sleeve;

a first switch lever having first ratchet pawls each engageable with said first ratchet teeth and said first switch lever being provided on one side of said first wrench sleeve; and first rotating means for enabling said first wrench sleeve to be rotated such that said first wrench hole can be directed downwardly or upwardly, said first wrench sleeve having a barrel shape, and said first wrench sleeve being mounted within said first wrench receiving portion of said grip handle so as to be rotatable through 360°, both clockwise and counterclockwise in a vertical direction about an axis parallel to a length of said first end portion, such that said first and second wrench holes are reversible upside down;

said wrench further including a second wrench sleeve, wherein third and fourth wrench holes different in size are formed in a top and a bottom, respectively, of said second wrench sleeve mounted horizontally rotatable within said second wrench receiving portion provided at said second end of said grip handle;

second ratchet means for stopping said second wrench sleeve for wrench operation;

second ratchet teeth formed on an outer peripheral surface of said second wrench sleeve;

a second switch lever having second ratchet pawls each engageable with said second ratchet teeth and said second switch lever being provided on one side of said second wrench sleeve; and a second rotating means for enabling said second wrench sleeve to be rotated such that said third wrench hole being directed downwardly or upwardly, said second wrench sleeve having a barrel shape, and said second wrench sleeve being mounted within said second wrench receiving portion of said grip handle so as to be rotatable through 360°, both clockwise or counterclockwise in a vertical direction about an axis parallel to a length of said second end portion, such that said third and fourth wrench holes are reversible upside down.

5. The wrench according to claim 4, wherein said first wrench sleeve is rotatable through 360° in both a clockwise or a counter-clockwise in any direction of horizontal plane under the condition that the engagement of said ratchet teeth is released from said first ratchet pawls, and wherein said second wrench sleeve is rotatable through 360° in both a clockwise or a counterclockwise in any direction of a horizontal plane under the condition that the engagement of said ratchet teeth is released from said second ratchet pawls.

6. The wrench of claim 4, wherein said grip handle is formed of a pair of plates and an intermediate plate interposed between said pair of plates, whereby said first wrench sleeve is held rotatably between said pair of plates.

7. The wrench of claim 4, wherein said grip handle is formed of a pair of plates and an intermediate plate interposed between said pair of plates, whereby said second wrench sleeve is held rotatably between said pair of plates.

8. A wrench comprising:

a grip handle having a wrench receiving portion formed in an end portion thereof;

at least one wrench sleeve, said wrench receiving portion being formed in said end portion of said grip handle, the end portion being formed by bending, so that, when an intermediate portion of said grip handle is slanted, the wrench receiving portion is horizontal, said wrench sleeve being mounted horizontally rotatable within said wrench receiving portion and having first and second wrench holes different in size being formed at a top and a bottom of said wrench sleeve;

ratchet teeth formed on an outer peripheral surface of said wrench sleeve; and a switch lever having ratchet pawls each engageable with said ratchet teeth, said switch lever being provided on one side of said wrench sleeve;

said grip handle being formed of a pair of plates and an intermediate plate interposed between said pair of plates, and wrench receiving holes being formed at a top and a bottom of said end portion of said grip handle;

said wrench sleeve having a barrel shape, and being mounted between said wrench receiving holes, said wrench receiving holes opposite at the top and the bottom of the end portion of said grip handle, so that said wrench sleeve is rotatable through 360° both clockwise and counterclockwise in any direction of a horizontal plane, such that said first and second wrench holes are reversible upside down and horizontally rotatable.

9. A wrench comprising:

a grip handle having wrench receiving portions, one of said wrench receiving portions formed in each of first and second end portions of said grip handle;

wrench sleeves, said wrench receiving portions being formed in both said first and second end portions of said grip handle, the first and second end portions being formed by bending, so that, when an intermediate portion of said grip handle is slanted, the wrench receiving portions are horizontal, said wrench sleeves being mounted horizontally rotatable within said wrench receiving portions and having first and second wrench holes different in size being formed at tops and bottoms of said wrench sleeves;

ratchet teeth formed on an outer peripheral surface of each of said wrench sleeves; and a switch lever having ratchet pawls each engageable with said ratchet teeth, said switch lever being provided on one side of said wrench sleeves;

said grip handle being formed of a pair of plates and an intermediate plate interposed between said pair of plates, and wrench receiving holes being formed at tops and bottoms of said end portions of said grip handle;

said wrench sleeves having a barrel shape and being mounted between said wrench receiving holes, said wrench receiving holes being opposite at the tops and the bottoms of the end portions of said grip handle, so that said wrench sleeves are rotatable through 360° in both a clockwise or a counterclockwise direction of a horizontal plane, such that said first and second wrench holes are reversible upside down and horizontally rotatable.

* * * * *